US005615728A

United States Patent [19]

Lee

[11] Patent Number: 5,615,728

[45] Date of Patent: Apr. 1, 1997

[54] UNDERCUT TREATING DEVICE OF DIE CASTING MOLD

[75] Inventor: Sangkyu Lee, Kyungsangnam-do, Rep. of Korea

[73] Assignee: Hyundai Motor Company, Seoul, Rep. of Korea

[21] Appl. No.: 350,004

[22] Filed: Nov. 29, 1994

[30] Foreign Application Priority Data

Dec. 8, 1993 [KR] Rep. of Korea ..... 93-26867

[51] Int. Cl.[6] ..... B22D 17/24

[52] U.S. Cl. ..... 164/340; 164/312; 164/342

[58] Field of Search ..... 164/340, 342, 164/312, 132

[56] References Cited

FOREIGN PATENT DOCUMENTS

| | | | |
|---|---|---|---|
| 2418215 | 11/1974 | Germany | 164/340 |
| 1-99765 | 4/1989 | Japan | 164/340 |
| 1-210163 | 8/1989 | Japan | 164/340 |
| 2-59141 | 2/1990 | Japan | 164/132 |

*Primary Examiner*—J. Reed Batten, Jr.

*Attorney, Agent, or Firm*—Birch, Stewart, Kolasch & Birch, LLP

[57] ABSTRACT

A sliding core is slidably mounted around the movable die and forms an undercut portion. A first channel communicates with the undercut portion and a second channel communicates with the first channel. A first device for forming the undercut is movably disposed in the first channel. A second device is movably disposed in the second channel for displacing the first device into the undercut portion to form the undercut when a molten metal is poured into the mold.

9 Claims, 3 Drawing Sheets

UNDERCUT TREATING DEVICE OF DIE CASTING MOLD

BACKGROUND OF THE INVENTION

1. Field of the Invention

The present invention relates to an undercut treating device of a die casting mold and a method for treating the undercut, which can improve working safety and productivity by automating the treatment of the undercut.

2. Description of the Related Prior

In general, a conventional die casting machine includes a sliding block mounted between a fixed die and a movable die to produce a product which has a concave portion such that the cast product cannot be ejected in a direction where a mold closes or opens.

Although such a sliding block has caused the mold to be complicated, because of an advantage that the product can be formed by only one process, the sliding block has been used.

The sliding block is used to prevent the undercut from sticking to the mold and avoid ejection of the cast product. However, the most important element when designing the mold is to avoid the trouble with the mold.

Particularly, to cast a transmission case for a vehicle, the die cast mold having an undercut treating means should be used.

FIG. 3 is a side sectional view of a conventional die casting mold. The die casting mold comprises a movable holder 4 supported on a die base 2, a movable die 6 seated on the movable holder 4, and a fixed die 10 mounted on a fixed holder 8 in opposition to the movable die.

A sliding core 12 is located between the movable die 6 and the fixed die 10 and fixed to a sliding holder 14, which operates frontward and rearward, to slide therewith.

In this mold, cavities are formed between the movable and fixed dies 6 and 10 and the sliding core 12. That is, as shown in FIG. 3, a channel is defined on the sliding core 12 to form an undercut and a loose piece 16 is inserted into the sliding core 12. A product is cast into cavities C in a state that the loose piece is inserted into the sliding core 12.

However, the cast product which is cast by the above die casting mold should be separated from the loose piece 16 and, after one cycle of the casting is completed, the loose piece 16 should be inserted again to the mold.

Accordingly, work for inserting the loose piece to the mold and for separating the loose piece from the cast product is required such that productivity and working safety are deteriorated.

SUMMARY OF THE INVENTION

Accordingly, the present invention is made in an effort to solve the above-described problems.

It is an object of the present invention to provide an undercut treating device of a die casting mold and a method for treating the undercut, which can improve working safety and productivity by automating the treatment of the undercut.

A sliding core slidably mounted around the movable die and forming an undercut portion according to the present invention is provided with an undercut portion, and a first channel communicating with an undercut portion, a second channel communicating with the first channel.

A first means for forming the undercut is movably disposed in the first channel.

A second means for displacing the first means into the undercut portion to form the undercut when a molten metal is poured into the mold is disposed on the second channel.

BRIEF DESCRIPTION OF THE DRAWINGS

Further objects and other advantages of the invention will become apparent from the following description in conjunction with the attached drawings, in which.

DETAILED DESCRIPTION OF THE EMBODIMENT

Figure 1:
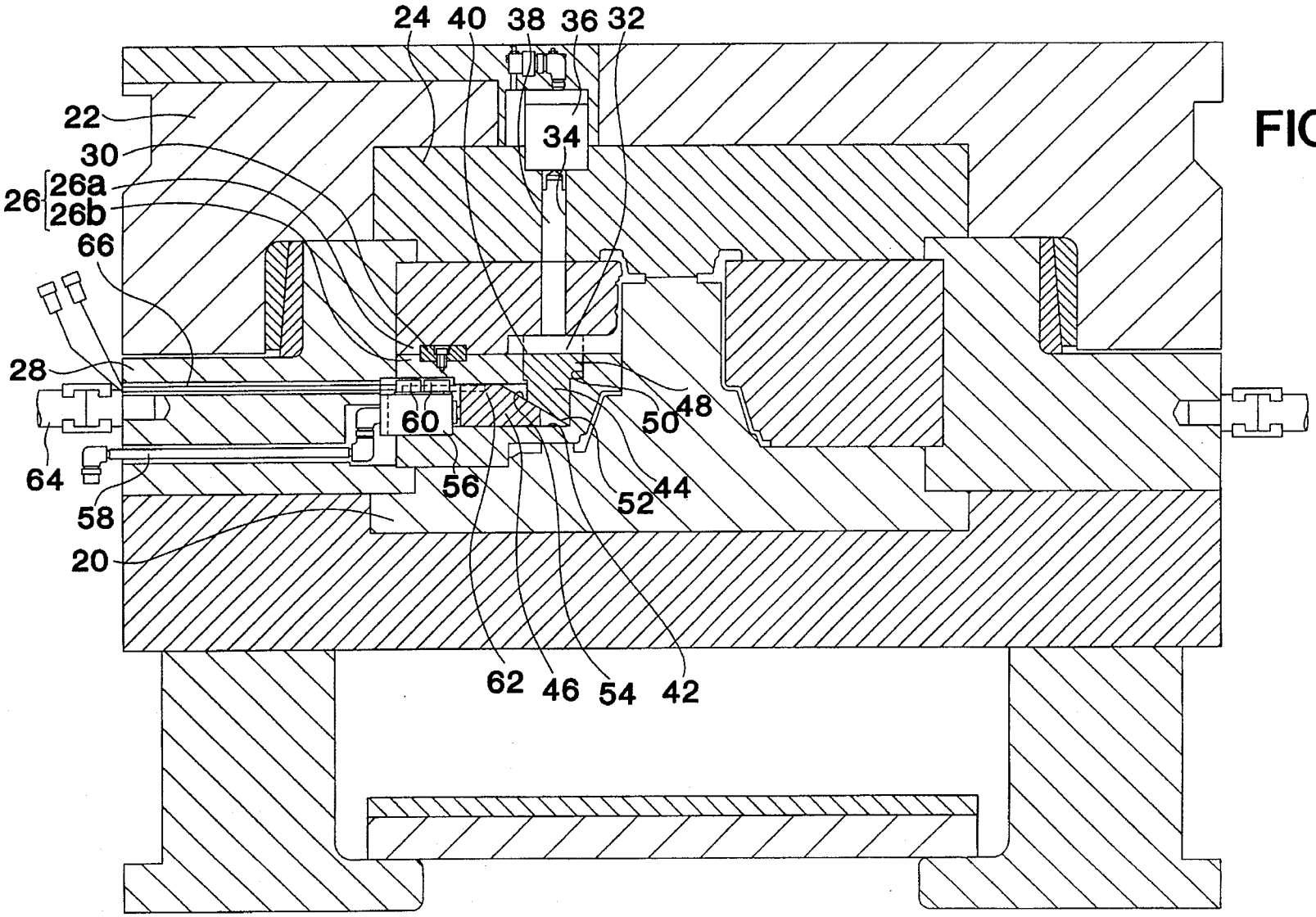
FIG. 1 is a side sectional view of a die casting mold in accordance with a preferred embodiment of the present invention.
Figure 2:
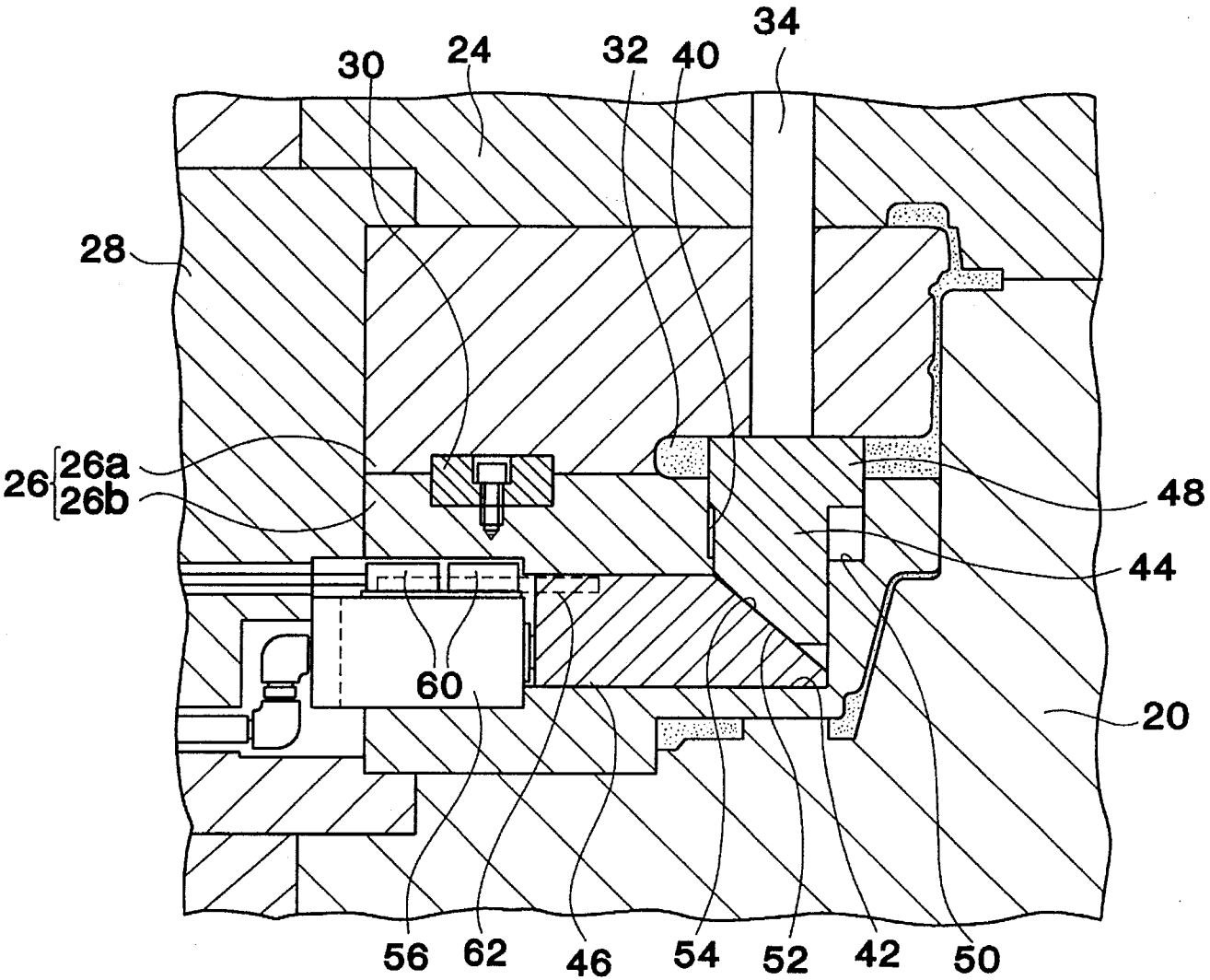
FIG. 2 is an enlarged half sectional view of a die casting mold in accordance with a preferred embodiment of the present invention.
Figure 3:
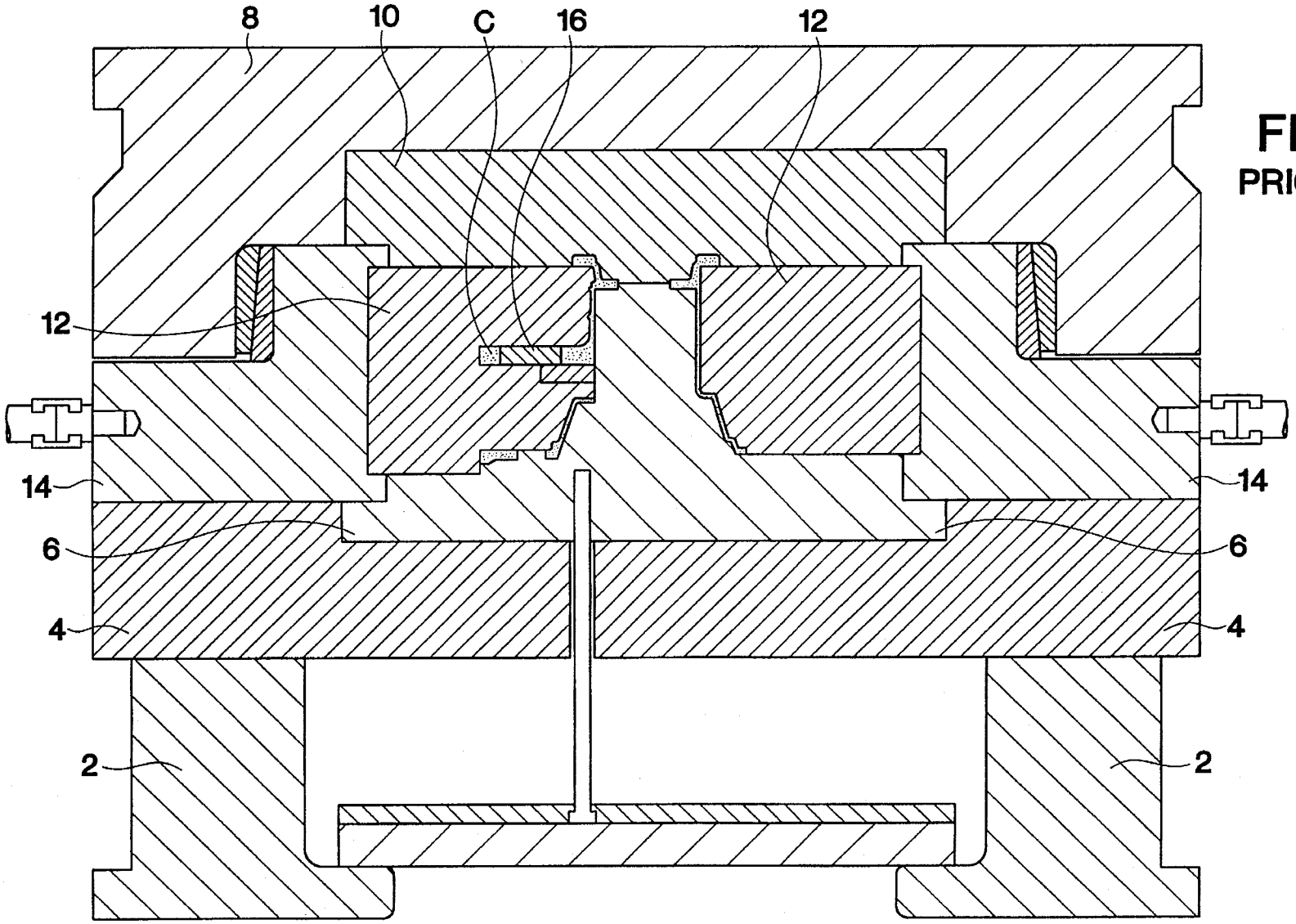
FIG. 3 PRIOR ART
FIG. 3 is a side sectional view of a conventional die casting mold.

FIGS. 1 and 2 show a side sectional view and an enlarged half sectional view of a die casting mold in accordance with a preferred embodiment of the present invention, respectively. The die casting mold comprises a movable die 20, a fixed die 24 set on a fixed holder 22 above the movable die 20, and a sliding core 26 fixed to a sliding holder 28 at a side of the movable die 20. The sliding core 26 is moved by a predetermined stroke by an operation of a hydraulic cylinder (not shown).

The sliding core 26 is separated into an upper core **26*a* and a lower core 26*b* which are set by a position determining block 30. An undercut portion 32 is formed between the upper and lower cores 26*a* and 26*b***.

The upper core **26*a* is provided with a hole 34 which communicates with the undercut cavity 32 and through which a piston rod 38 of a vertically arranged cylinder 36** passes.

The lower half core **26*b* is provided with a vertical channel 40 communicating with the undercut cavity portion 32 and a horizontal channel 42 communicating with the vertical channel 40**.

An undercut cam 44 is movably disposed in the vertical channel 40 and a control cam 46 is movably disposed in the horizontal channel 42. The undercut cam 44 is further provided with a flange 48 which is to be hooked on a jaw portion 50 formed on the vertical channel 40 to prevent the undercut cam 44 from further descending.

A lower surface 52 of the undercut cam 44 is inclined such that the inclined lower surface 52 permits the control cam 46 to push the undercut cam upward.

To achieve this operation, the control cam 46 is also provided with an inclined surface 54 which can be in contact with the inclined surface 52 of the undercut cam 44 in face to face manner.

The inclined surfaces 52 and 54 are to be in partial contact with each other when the undercut cam 44 descends to a lowermost side.

The undercut cam 44 ascends when the control cam 46, which is connected with a piston rod of a cylinder 56, longitudinally moves in the horizontal channel 42.

The cylinder 56 is operated by a hydraulic pressure which is supplied from a hydraulic pressure generating system(not shown) through a tube 58 which passes into the sliding holder 28.

A vertically arranged cylinder 36 operates in a manner similar to the operation of the cylinder 56.

The vertically arranged cylinder 36 is mounted on the fixed die 24. The cylinder 56 should be mounted on the sliding core 26 since the cylinder 56 should be operated simultaneously with opening the mold.

Limit switches 60 are disposed on the cylinder 56 to limit the moving distance of this cylinder 56. The limit switches 60 are fixed to the control cam 46 to be turned ON/OFF by means of a dog 62 which moves together with the control cam 46.

The reference numeral 64 indicates a piston rod of the hydraulic cylinder(not shown), by which the sliding holder 28 is moved, and the reference numeral 66 indicates a passage formed on the sliding holder 28, on which a wire connected to the limit switch 60 is disposed.

Accordingly, in the undercut treating device as described above and shown in FIG. 1, since the casting operation is achieves in a state where the undercut cam 44 comes off the undercut portion formed in cavity 32, a product can be cast without treating the undercut.

That is, to eject the cast product, the movable die 20 and the fixed die 24 are separated from each other and then the hydraulic cylinder is retracted to move the sliding holder 28 in the lateral direction thereby moving the sliding core 26.

The casting and ejecting methods are same as that of the conventional method which cast a product without the undercut.

However, in the state of FIG. 1, when the cylinder 56 moves forward, the control cam 46 moves rightward in the drawing. At this point, since the inclined surface 54 of the control cam 46 is in contact with the inclined surface 52 of the undercut cam 44, the undercut cam 44 is ascended by the movement of the control cam 46.

By this operation, the upper portion of the undercut cam 44 is displaced into the undercut portion formed in cavity 32 on the sliding core 26 as shown in FIG. 2.

To achieve this operation, the piston rod 38 should not be displaced into the undercut portion 32 by the operation of the vertically arranged cylinder 36.

In the state of FIG. 2, when the molten metal is poured into the casting mold, the molten metal is introduced into the undercut cavity portion 32 and surrounds the undercut cam 44.

At this state, after cooling the molten metal, the treatment of the undercut for ejecting the cast product from the mold will be described hereinafter.

The cylinder 56 is operated to move the control cam 46 laterally and, at this point, since the undercut cam 44 is in an insertion state into the undercut by the solidification of the molten metal, the undercut cam 44 does not descend even though the control cam 46 moves laterally.

At this state, the piston rod 38 descends and pushes the undercut cam 44 downward by the operation of the vertically arranged cylinder 36 such that the undercut cam 44 is ejected from the cast product.

As described above, when the undercut cam 44 is ejected from the cast product, the hydraulic pressure is operated to move the sliding holder 28 in the lateral direction. At this point, the sliding core 26 moves in the lateral direction simultaneously and a portion of the cast product formed in the undercut cavity portion 32 is entirely exposed.

In this state, when the conventional ejecting means is operated, the cast product is separated from the movable die 20.

As described above, the undercut treating device according to the present invention is operated by steps of (1) locating the undercut cam in the die casting mold for forming the undercut, (2) ascending the undercut cam to the undercut portion to form the undercut, (3) descending the undercut cam after forming the undercut, and separating the mold. Accordingly, since a special piece which has been used in the conventional art is not needed, work for mounting the piece on the mold and separating the piece from the cast product is not also needed and the productivity and working efficiency are improved.

Although preferred embodiments of the present invention have been described in detail hereinabove, it should be clearly understood that many variations and/or modifications of the basic inventive concepts herein taught which may appear to those skilled in the pertinent art will still fall within the spirit and scope of the present invention, as defined in the appended claims.

What is claimed is:

1. An undercut treating device of a die casting mold, comprising:

a movable die;

a sliding core slidably mounted around the movable die and forming an undercut portion for forming an undercut, said sliding core being provided with an undercut portion, a first channel communicating with an undercut portion, a second channel communicating with the first channel;

a first means for forming the undercut, said first means being movably disposed in the first channel; and a second means, movably disposed in the second channel, for displacing the first means into the undercut portion to form the undercut when a molten metal is poured into the mold.

2. The undercut treating device of the die casting mold according to claim 1, wherein the first channel is orthogonal to the second channel.

3. The undercut treating device of the die casting mold according to claim 1, wherein the sliding core is further provided with a third channel and the die casting mold further comprises third means for pushing the second means to separate the second means from a cast product after solidifying the molten metal, said third means being disposed in the third channel.

4. The undercut treating device of the die casting mold according to claim 3, wherein the first and third channels are arranged to be in-line.

5. The undercut treating device of the die casting mold according to claim 1, wherein the first means comprises an undercut cam which is provided with an inclined surface.

6. The undercut treating device of the die casting mold according to claim 1, wherein the second means comprises a piston rod operated by a first cylinder and a control cam connected with the piston rod, said control cam being provided with an inclined surface in contact with the inclined surface of the undercut cam in a face to face manner to push the undercut cam to the undercut portion by an operation of the cylinder.

7. The undercut treating device of the die casting mold according to claim 3, wherein the third means comprises a piston rod operated by a second cylinder to push the first means to separate the first means from the cast product.

8. The undercut treating device of the die casting mold according to claim 6, wherein the second means further comprises a limit switch for limiting the moving distance of the control cam and a dog for turning the limit switch to be ON/OFF.

9. The undercut treating device of the die casting mold according to claim 6, wherein the first cylinder is mounted within the mold.

* * * * *